US006913097B1

(12) United States Patent
Orr et al.

(10) Patent No.: US 6,913,097 B1
(45) Date of Patent: Jul. 5, 2005

(54) TRANSPORTATION, STORAGE, AND INSTALLATION SYSTEM FOR RIG UTILITIES

(75) Inventors: Alan Orr, Tulsa, OK (US); Samuel David Hampton, Wagoner, OK (US); Bernard J. Cook, Tulsa, OK (US); Robert Lewis Underwood, Bixby, OK (US); Eric Thomas Greager, Owasso, OK (US)

(73) Assignee: Helmerich & Payne, Inc., Tulsa, OK (US)

( * ) Notice: Subject to any disclaimer, the term of this patent is extended or adjusted under 35 U.S.C. 154(b) by 117 days.

(21) Appl. No.: 10/423,657

(22) Filed: Apr. 25, 2003

(51) Int. Cl.[7] ..... E21B 19/084
(52) U.S. Cl. ..... 175/162; 175/220
(58) Field of Search ..... 175/162, 202, 175/220, 89, 90; 166/77.1

(56) References Cited

U.S. PATENT DOCUMENTS

| | | | | |
|---|---|---|---|---|
| 4,003,435 | A | 1/1977 | Cullen et al. | 166/315 |
| 5,755,296 | A | 5/1998 | Richardson et al. | 175/162 |
| 5,944,418 | A | 8/1999 | Orr et al. | 366/245 |
| 6,161,358 | A | 12/2000 | Mochizuki et al. | 52/651.05 |
| 6,533,045 | B1 * | 3/2003 | Cooper | 173/28 |
| 6,634,436 | B1 | 10/2003 | Desai | 173/1 |

FOREIGN PATENT DOCUMENTS

| | | | |
|---|---|---|---|
| DE | 3441299 | A1 | 5/1986 |

* cited by examiner

*Primary Examiner*—Zakiya Walker
(74) *Attorney, Agent, or Firm*—Head, Johnson & Kachigian

(57) ABSTRACT

A transportation, storage and installation device for rig utilities. The device includes a telescoping bridge having an outer frame assembly with an opening therethrough supporting a plurality of cables. The telescoping bridge also includes an inner beam assembly receivable within the outer frame assembly opening supporting a plurality of cables, wherein the inner beam assembly may be extended from or retracted into the opening. The device also includes a utility boom having an elongated post terminating in a rotatable boom base, and a boom pivotally connected to the boom base wherein the pivotal connection has an axis transverse to the post. At least one cylinder moves the boom from a storage position substantially perpendicular to the post to a position wherein the boom is at an obtuse angle to the storage position. The device also includes a service arm supporting a plurality of electrical cables. The service arm includes a hinge having an axis transverse to the service arm to permit the arm to swing radially about the axis. The device also includes a pipe trolley mechanism to store high pressure fluid lines for storage and transportation and thereafter to provide a mechanism to interconnect high pressure mud pumps to the base of the mast at the substructure.

10 Claims, 7 Drawing Sheets

TRANSPORTATION, STORAGE, AND INSTALLATION SYSTEM FOR RIG UTILITIES

BACKGROUND OF THE INVENTION

1. Field of the Invention

The present invention relates to an apparatus to organize rig utilities for assembly and disassembly at a rig site and to transport various rig utilities for a drilling or workover rig.

2. Prior Art

To operate a drilling or workover rig, a great number of different pieces of equipment must be brought together and assembled at a site. Many pieces of equipment require power, such as electrical power, which usually is generated onsite by a generator or generators. In some instances, power produced by generators is directed to a variable frequency drive house and then on to drive motors and a motor control center which acts as a power distribution center for various equipment at the drilling rig site.

A motor control center may include electrical switches, electrical brakers and motor starters as well as various types of transformers. From the motor control center, the electrical power is delivered by cables to various pieces of equipment.

For example, drilling mud is pumped downhole by electricity driven pumps to transport drill cuttings to the surface and lubricate the drill bit at the drilling location. The drilling mud is re-used after passing through a vibrating shaker to remove solids. Various pieces of equipment are electrically powered such as mud pumps, agitators, shale shakers, drawworks and other equipment on the rig site.

In the drilling mud system at a rig site, mud stored in tanks is delivered through high pressure fluid lines to a pump or pumps and thereafter delivered to a drill floor for use downhole for example through a top drive.

It would be desirable to organize electrical utility cables at a rig site to avoid injuries and increase efficiency.

It would be desirable to transport the various electrical cables from site to site in a unitized and organized manner.

It would also be desirable to eliminate some of the manual labor typically required to install and remove electrical cables each time the rig is assembled and disassembled.

It would also be desirable to provide a protected arrangement for the electrical utility cables between the power distribution center and the drill floor and mud system.

It would also be desirable to provide a skid mounted motor control center which facilitates storage and transportation of electrical cables and high pressure mud line piping.

It would also be desirable to organize high pressure fluid mud lines at a rig site to avoid injuries and to increase efficiency during rig assembly and disassembly.

SUMMARY OF THE INVENTION

The present invention provides a transportation, storage, and installation system for various rig utilities on a drilling or workover rig.

Electrical power for equipment at a drilling rig may be produced by generators, driven by diesel engines. In one configuration, electrical power from the generators is directed to a variable frequency drive house. From the variable frequency drive house, electrical power is directed via electrical cables to a motor control center building and then to all of the various pieces of equipment at the drilling rig site.

A telescoping bridge assembly transports electrical cables from the variable frequency drive house to the motor control center. The telescoping bridge assembly also acts to store electrical cables when the rig is not in use and during transportation. The telescoping bridge assembly includes an outer frame assembly having an opening therethrough. The outer frame assembly is supported on and moveable on a bridge track which is mounted on the motor control center building, such as on the roof of the building. The outer frame assembly moves from a retracted position on the building to an extended position.

The telescoping bridge assembly also includes an inner beam assembly which is receivable within the outer frame assembly. The inner beam assembly moves on a plurality of rollers and supports a plurality of electrical cables. The inner beam assembly may be extended from or retracted into the opening of the outer frame assembly.

The present invention also includes an elongated service arm assembly. The elongated service arm supports a plurality of electrical cables and permits the electrical cables to be stored when not in use and during transportation. The elongated service arm includes a hinge having an axis transverse to the elongated service arm in order to permit the arm to swing radially about the axis. The hinge includes a pin passing through the axis with the pin held by a bracket secured to the roof of the motor control center building.

The present invention also includes a utility boom assembly which is capable of moving between a storage and transportation position and a use position.

The utility boom assembly includes an elongated post terminating in a rotatable boom base. A boom is pivotally connected to the rotatable boom base. The pivotal connection has an axis transverse to the base. The boom itself will support a plurality of electrical cables and will rotate about the axis.

The utility boom assembly includes a first hydraulic cylinder to move the boom between a transportation and storage position substantially perpendicular to the elongated post to a position at an obtuse angle to the storage position. An extended end of the first hydraulic cylinder is connected to a sliding saddle which is permitted to slide along the boom. The sliding saddle is, in turn, also connected to a second hydraulic cylinder. The second hydraulic cylinder is connected at an opposite end to a fixed point on the boom. Accordingly, the first cylinder is initially extended so that the boom begins to move toward the use position. Once the first cylinder has been fully extended, the second cylinder will be extended so that the boom will be in a position at an obtuse angle to the original storage and transportation position. When in use, the utility boom assembly permits electrical cables to be delivered from the motor control center building to the drill floor and to the mast of the drilling rig.

The utility boom assembly also has a mechanism to rotate the boom by a ratchet mechanism.

The present invention also includes a pipe trolley mechanism to store high pressure fluid lines for storage and transportation and thereafter to provide a mechanism to interconnect high pressure mud pumps to the base of the mast at the substructure.

A first high pressure fluid line is mounted on the motor control center building. A second pipe high pressure fluid line is attached to the outer frame assembly of the telescoping bridge assembly. Accordingly, with the outer frame assembly extended, the second high pressure fluid line is extended from the motor control center. The first fluid line and the second fluid line are substantially parallel to each other. Once the outer frame assembly is extended, hammer unions can be employed to join the first fluid line to the second fluid line. For storage and transportation, the hammer unions can be disconnected, and the outer frame assembly with the second high pressure line attached can be retracted.

BRIEF DESCRIPTION OF THE DRAWINGS

FIG. 18 shows a utility boom assembly apart from the invention while

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
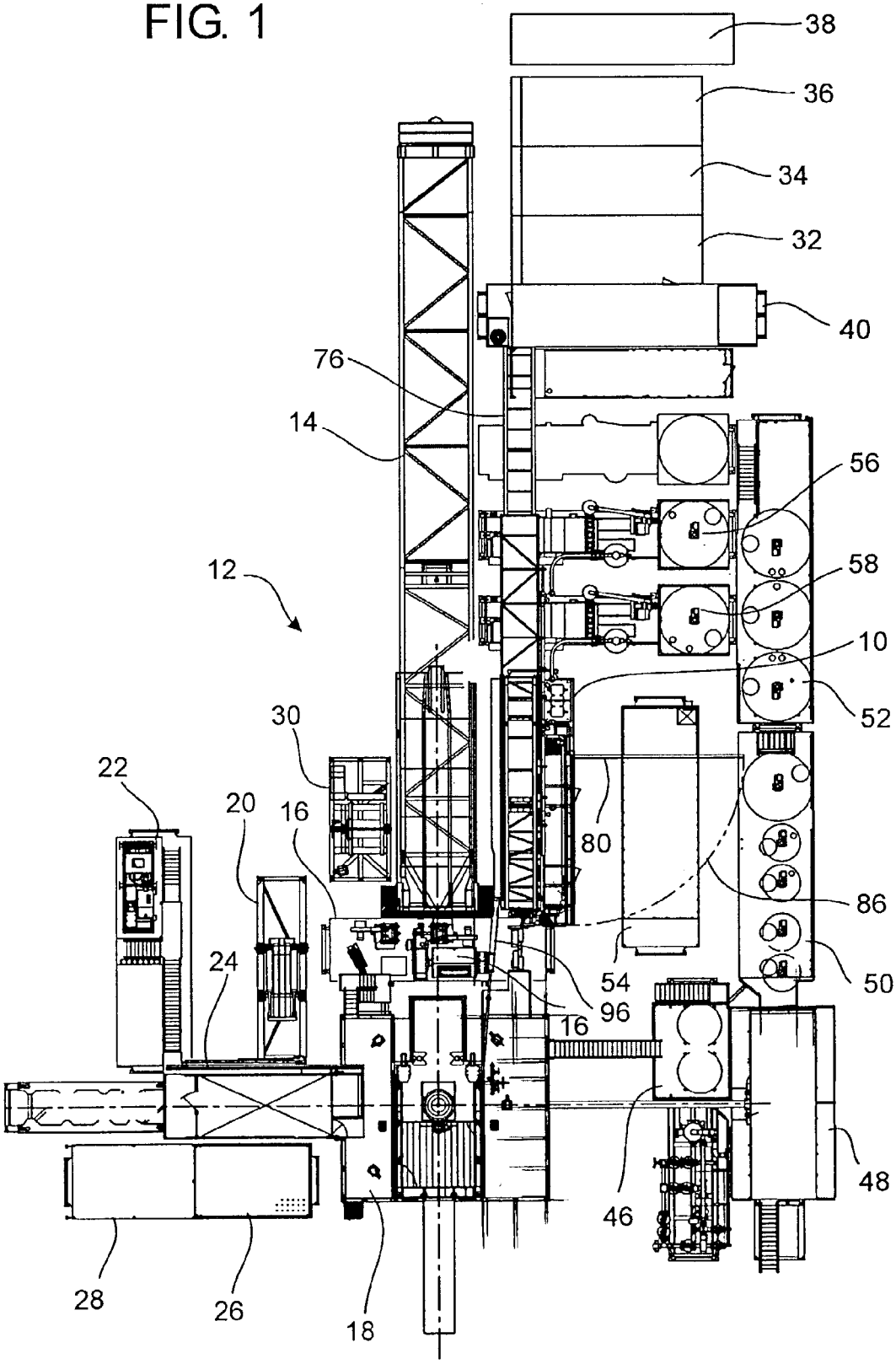
FIG. 1 is a top view of a transportation, storage, and installation device for various rig utilities constructed in accordance with the present invention shown in use with a drilling rig and the various pieces of equipment that support the drilling rig at a rig site.

Referring to the drawings in detail, FIG. 1 is a top view of a transportation, storage and installation device 10 for various rig utilities used on a drilling rig 12. A great number of various pieces of equipment are brought to and assembled at a rig site. Once drilling operations have been performed and completed, the various pieces of equipment are disassembled and then transported to a new site so that the entire operation is repeated.

The drilling rig 12 includes a mast 14 shown in the horizontal position in FIG. 1 prior to being raised to the vertical position. The drilling rig also includes a drawworks 16 mounted on a skid, a substructure 18 including a drill floor, a blow out preventer skid 20, a hydraulic power skid 22, a driller cabin 24 for personnel and controls, a tool house 26, a parts house 28 and a drill line storage spool 30.

It will be understood that the equipment may be arranged in other configurations within the scope of the invention.

Equipment at the drilling site may be powered in a number of ways including hydraulic power or electrical power. Electrical power for equipment at the drilling rig may be produced by generators driven by diesel engines, such as in skid mounted generator houses 32, 34 and 36. Fuel for the electrical generators may be stored in a fuel tank 38. Electrical power from the generators 32, 34 and 36 is directed to a variable frequency drive house 40. From the variable frequency drive house 40, electrical power is directed via electrical cables to a motor control center building, to be described in detail, and then to all of the various pieces of equipment at the drilling rig site.

When the drilling rig 12 is assembled at a site, the electrical cables are often manually connected and then allowed to lay on the ground. At the time operations are completed and the equipment is disassembled, the entire process is reversed.

The drilling fluid or mud system of the drilling rig 12 includes a trip tank 46, a vibrating separator or separators 48 or shakers mounted on a skid, mud process tanks 50, volume tanks 52 and a water tank 54. Drilling mud is moved through the mud system by skid-mounted pumps 56 and 58.

Drilling mud is directed from the pumps 56 and 58 via high pressure fluid lines to the drilling floor of the substructure 18. The drilling mud is used to transport cuttings from the drilling operation and to keep the drill bit lubricated, all as is well known in the art.

When the drilling rig 12 is assembled at the site, the high pressure fluid lines have in the past been brought to the side and manually connected.

Figure 3:
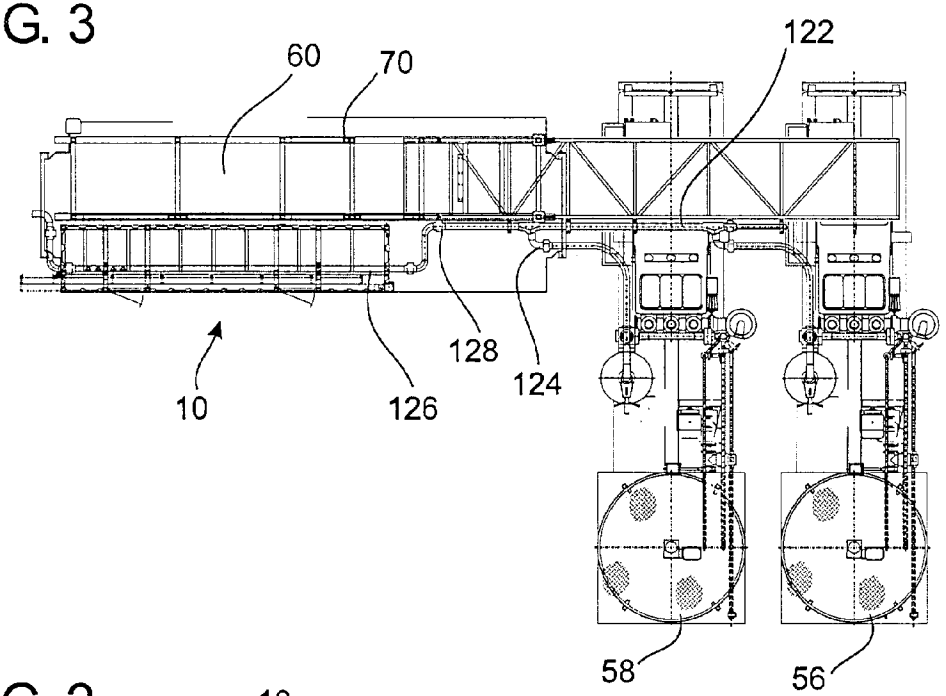
FIG. 3 illustrates a top view of the motor control center building which is a part of the present invention.
Figure 2:
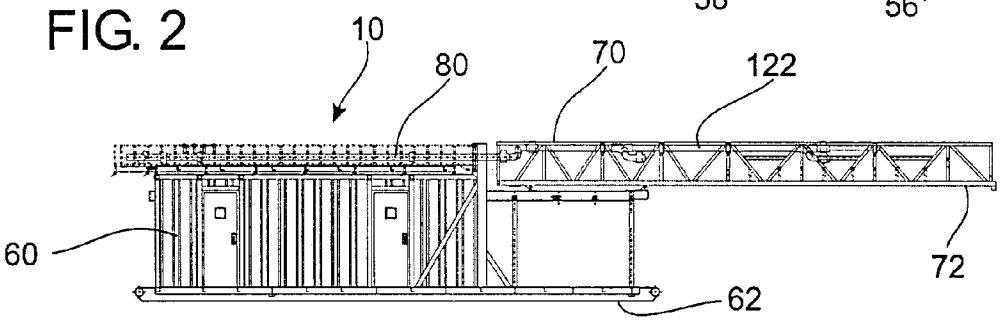
FIG. 2 illustrates a side view.

FIG. 2 illustrates a side view and FIG. 3 illustrates a top view of a motor control center building 60 which acts as a power distribution center and may include electrical switches, electrical brakers, and motor starters and transformers. The motor control center 60 is mounted on a skid 62 so that it may be readily transported to and from a drilling rig site. Electrical power is directed via cables from the variable frequency drive house 40 (not shown in FIGS. 2 and 3) to the motor control center.

A telescoping bridge assembly 70 transports electrical cables from the variable frequency drive house 40 to the motor control center 60 and the pumps 56 and 58. The telescoping bridge assembly 70 keeps the electrical cables off of the ground and provides mechanical protection. The telescoping bridge assembly 70 will also act to store electrical cables when the rig 12 is not in use and during transportation.

Figure 4:
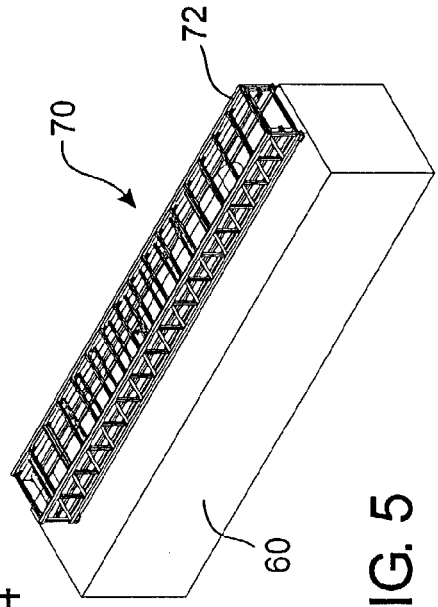
FIG. 4 shows a perspective view.
Figure 5:
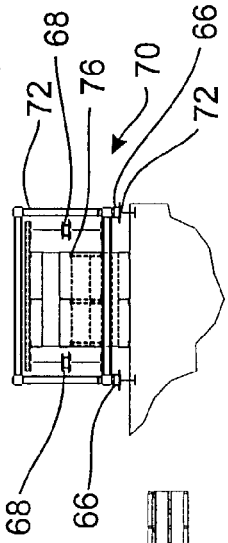
FIG. 5 shows an end view of a telescoping bridge assembly of the transportation, storage, and installation system of the present invention.
Figure 6:
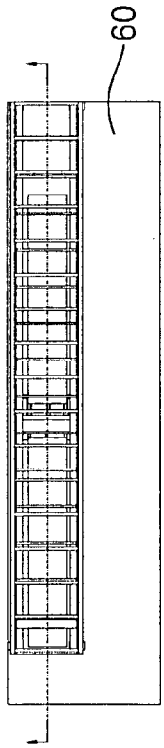
FIGS. 6 through 9 illustrate a sequential view of the telescoping bridge assembly.
Figure 7:
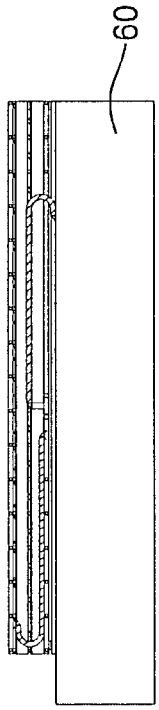
Figure 8:
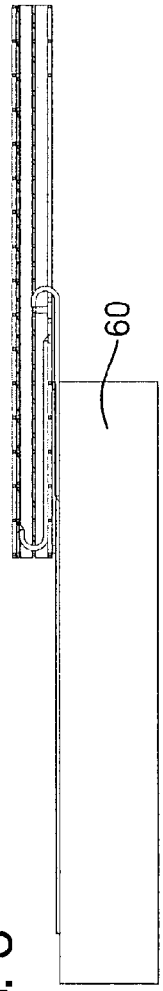

FIG. 4 illustrates a perspective view and FIG. 5 illustrates an end view of the telescoping bridge assembly 70 apart from the balance of the device 10. With continuing reference to FIGS. 2 and 3 and with reference to FIGS. 4 and 5, the telescoping bridge assembly 70 includes an elongated outer frame assembly 72 having an opening therethrough. The outer frame assembly is constructed to support a plurality of electrical cables. In the position shown in FIG. 4, the outer frame assembly 72 is supported on and movable on a bridge track which is mounted on the motor control center building 60 such as on the roof. The outer frame assembly moves on rollers 66 between a retracted storage position on the motor control center building 60 to a position extended from the motor control building as shown in FIGS. 2 and 3.

Figure 9:
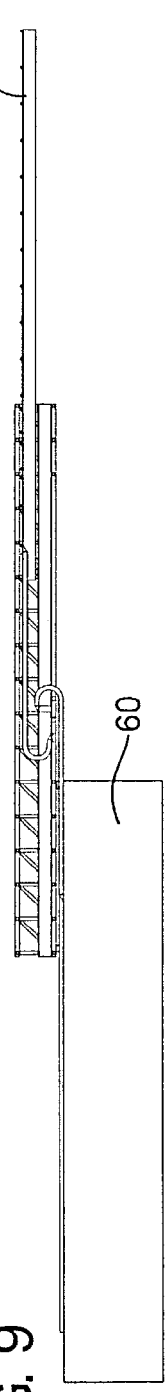

The telescoping bridge assembly 70 also includes an inner beam assembly 76 which is receivable within the opening of outer frame assembly 72. The inner beam assembly 76 may be seen in FIG. 1 and in the sequential views shown in FIGS. 6, 7, 8, and 9. In particular, FIG. 9 shows the inner beam assembly 76 fully extended for use.

The inner beam assembly 76 also supports a plurality of cables. The inner beam assembly may be extended from or retracted into the opening of the outer frame assembly. The outer frame assembly 72 moves with respect to the bridge track 74 on a plurality of rollers 66. Likewise, the inner beam assembly 76 moves on the outer frame assembly 72 on a plurality of rollers 68. As seen in FIGS. 6 through 9, the outer frame assembly includes a cable tray or trays to support the electrical cables.

Figure 10:
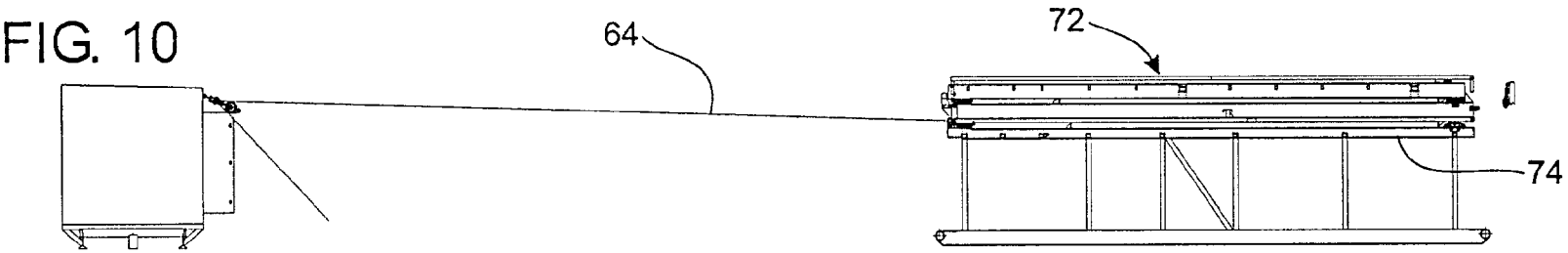
FIGS. 10 through 12 illustrate the procedure to extend and retract the telescoping bridge assembly.
Figure 11:
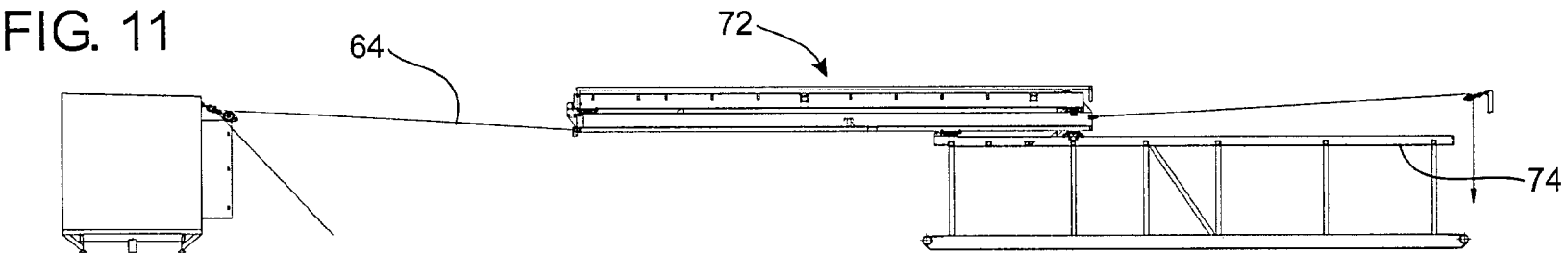
Figure 12:
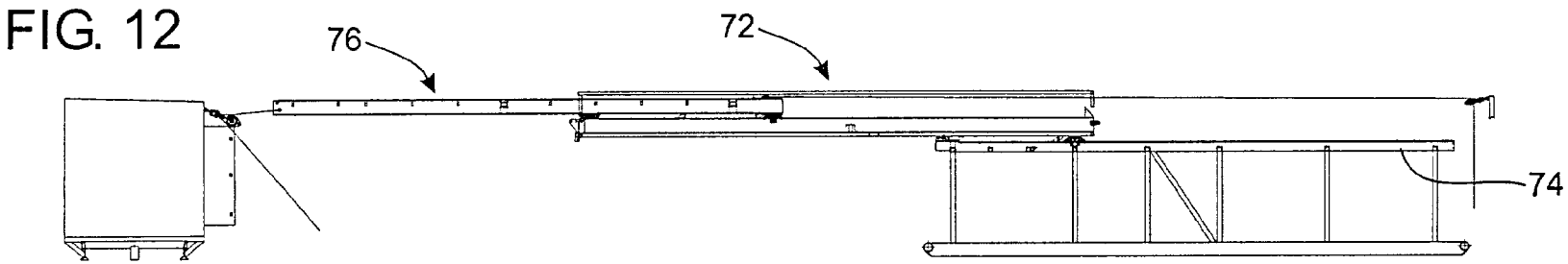

FIGS. 10, 11 and 12 illustrate one procedure for extending and retracting the telescoping bridge assembly 70. The outer frame assembly 72 may be connected by a cable 64 to another piece of equipment at the drilling site such as the variable frequency drive house 40 and then extended via the rollers. Thereafter, inner beam assembly 76 may be extended from the outer frame assembly 72 by the cable 64 attached to another piece of equipment at the drill site. The reverse procedure may be performed to retract the telescoping bridge assembly.

Figure 13:
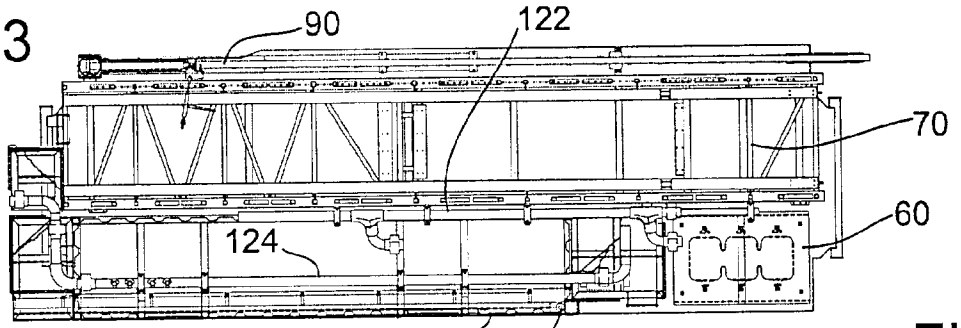
FIG. 13 shows a top view.
Figure 14:
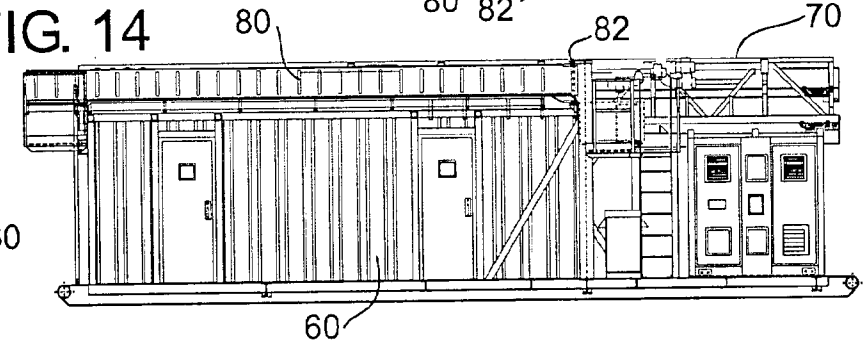
FIG. 14 shows a right side view.
Figure 15:
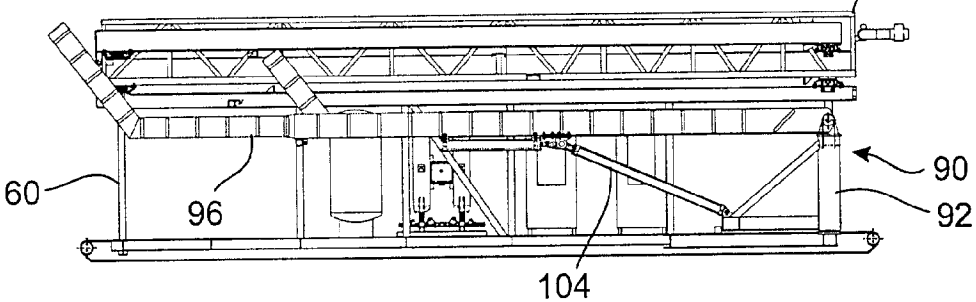
FIG. 15 shows a left side view.
Figure 16:
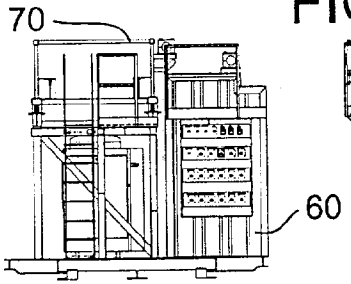
FIG. 16 shows a front view.
Figure 17:
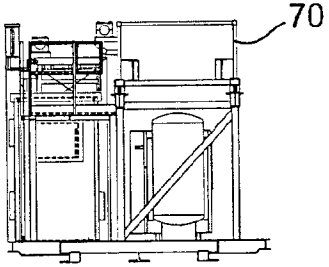
FIG. 17 shows a rear view of a motor control center building as well as the various elements of the present invention.

FIG. 13 shows a top view, FIG. 14 shows a right side view, FIG. 15 shows a left side view, FIG. 16 shows a front view and FIG. 17 shows a rear view of the motor control center building and various elements of the present invention. The telescoping bridge assembly 70 previously described may be seen from various vantage points.

The device 10 of the present invention also includes an elongated service arm assembly. The elongated service arm assembly supports a plurality of electrical cables and permits the electrical cables to be stored in the position shown in FIGS. 13 through 17 during storage and transportation. The elongated service arm 80 includes a hinge 82 having an axis transverse to the elongated service arm in order to permit the arm to swing radially about the axis. The hinge will include a pin passing through the axis with the pin held by a bracket secured to the roof of the motor control center building 60.

Figure 21:
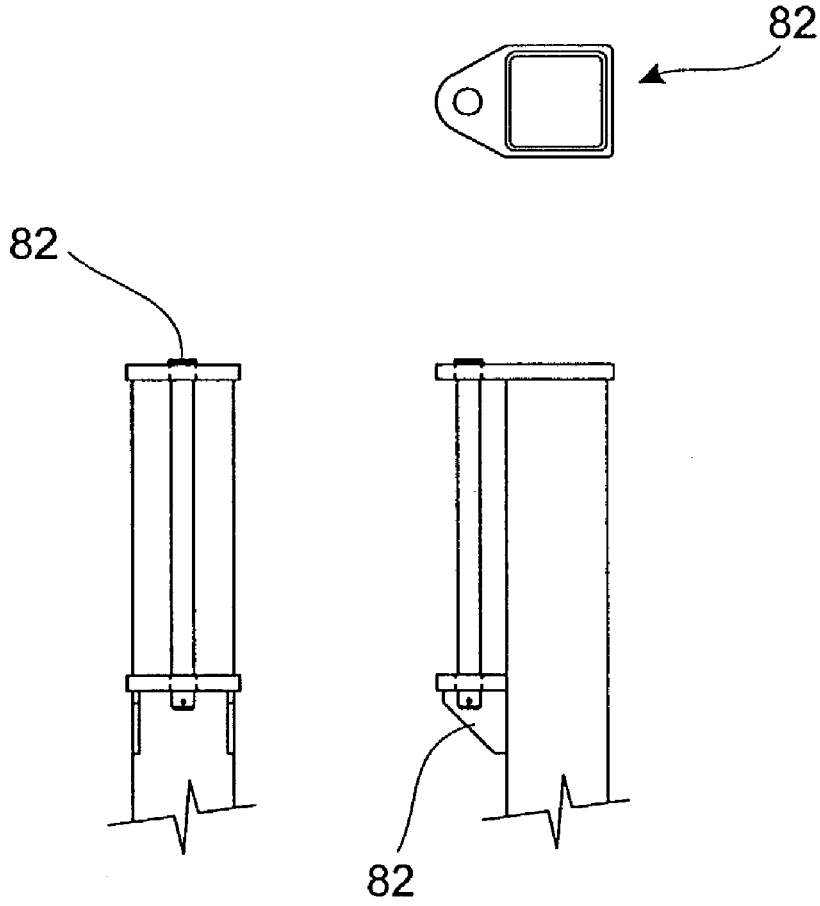
FIG. 21 illustrates views of a hinge for a service arm assembly.

FIG. 21 shows a front, side, and top view of the hinge 82 and pin for the service arm assembly.

Returning to a consideration of FIG. 1, the service arm 80 is shown in the extended position so that it is moved in the direction shown in dashed lines 86. In the configuration shown, the service arm 80 keeps the electrical cables off of the ground and spans the water tank 54. The service arm delivers electrical cables to the process tanks 50 and other equipment.

Figure 18:
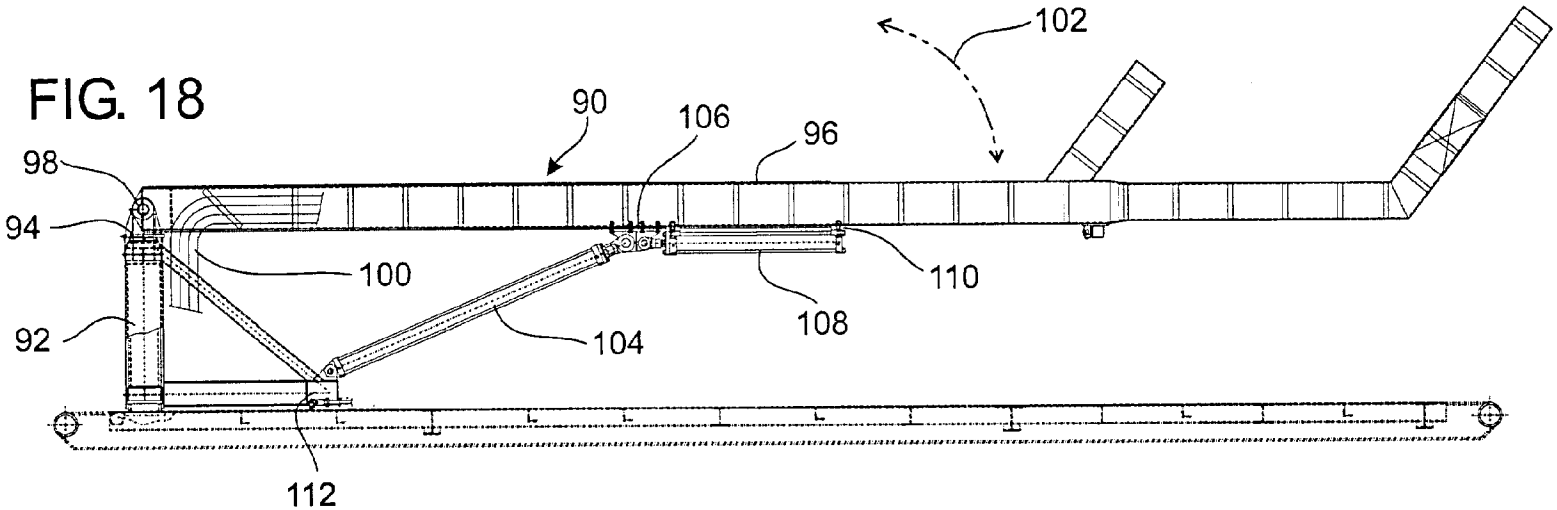
Figure 19:
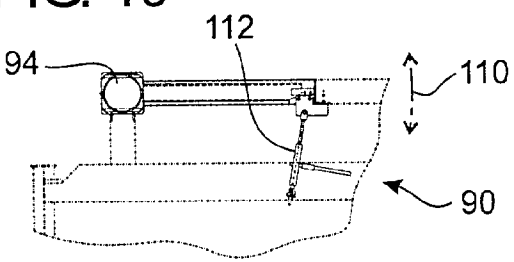
FIG. 19 shows a portion of the utility boom assembly.

The device 10 also includes a utility boom assembly 90 visible in FIGS. 13 and 15 and shown apart from the device for ease of illustration in FIGS. 18 and 19. In FIGS. 13 through 19, the utility boom assembly 90 is in the storage and transportation position and is capable of moving between the storage and transportation position and a use position.

Figure 20:
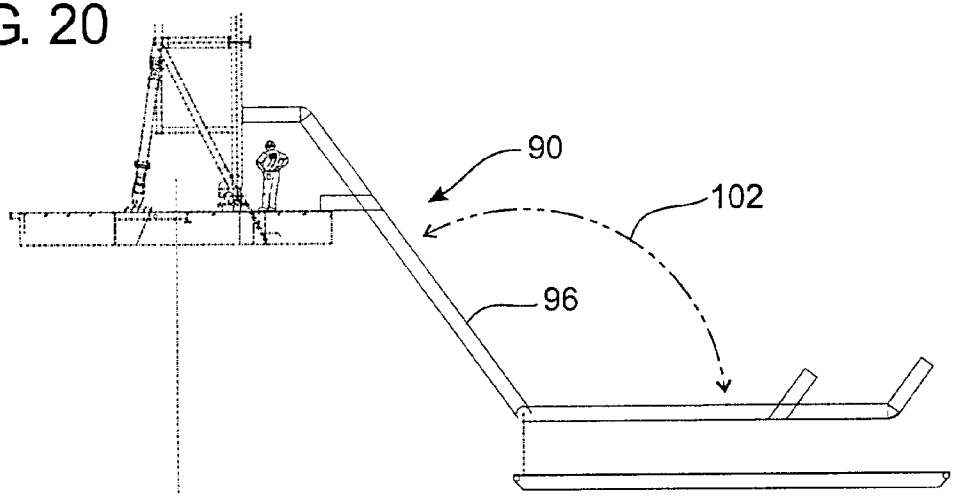
FIG. 20 illustrates a diagrammatic view of the utility boom assembly moved into position for use.

The utility boom assembly 90 includes an elongated post 92 terminating in a rotatable boom base 94. A boom 96 is pivotally connected to the rotatable boom base 94. The pivotal connection has an axis 98 transverse to the base 94, as best seen in FIG. 18. The boom 96 will support a plurality of electrical cables 100 partially shown in FIG. 18. The boom 96 will move and rotate in the direction shown by arrow 102. The utility boom assembly 90 includes a first hydraulic cylinder 104 to move the boom 96 between a position substantially perpendicular to the elongated post 92 to a position at an obtuse angle to the storage position. An extended end of the first hydraulic cylinder 104 is connected to a sliding saddle 106 which is permitted to slide along the boom 96. The sliding saddle 106 is, in turn, also connected to a second hydraulic cylinder 108. The second hydraulic cylinder 108 is connected at one end to the sliding saddle and is connected at an opposite end to a fixed point 110 on the boom 96. Accordingly, as seen in the diagrammatic view in FIG. 20, the first cylinder 104 is initially extended so that the boom 96 begins to move in a radial direction shown by the arrows 102. Once the first cylinder 104 has been fully extended, the second cylinder 108 will be extended so that the boom 96 will be in a position at an obtuse angle to the original, storage position. As seen in FIG. 20, the use position of the utility boom assembly 90 permits electrical cables to be delivered to the drill floor and mast of the drilling rig. Accordingly, electrical power is delivered from the motor control building to the drill floor.

The utility boom assembly 90 also has a ratchet mechanism shown in FIGS. 18 and 19 to rotate the boom 96 by a ratchet so that the boom 96 can move in the direction shown in arrow 110.

By extending or retracting the ratchet assembly 112, the boom 96 will be moved to a desired location.

In order to install, the first cylinder will be extended followed by extension of the second cylinder. Thereafter, the ratchet assembly 112 will be employed to laterally position the boom.

The present invention 10 also includes a pipe trolley mechanism to store high pressure lines for storage and transportation and thereafter to provide a mechanism to interconnect the mud pumps to the base of the mast at the substructure 18. FIGS. 2 and 3 show the pipe trolley assembly. A second high pressure fluid line 122 is attached to the outer frame assembly 72 of the telescoping bridge assembly. Accordingly, with the outer frame assembly 72 extended, the second high pressure fluid line 122 is extended from the motor control center and has taps 124 so that the second fluid line 122 is in fluid communication with the pumps 56 and 58. A first high pressure fluid line 126 is mounted on the motor control center building, such as seen mounted on the roof in FIG. 3. The first fluid line 126 and the second fluid line 122 are substantially parallel to each other. As seen in FIG. 3, hammer unions 128 can be employed to join the first fluid line to the second fluid line when in the use position.

For storage and transportation, the hammer unions 128 can be disconnected, and the outer frame assembly 72 can be retracted so that the second high pressure line 122 is also retracted and resides on top of the motor control center building, as seen in FIG. 13.

Whereas, the present invention has been described in relation to the drawings attached hereto, it should be understood that other and further modifications, apart from those shown or suggested herein, may be made within the spirit and scope of this invention.

What is claimed is:

1. A transportation, storage and installation device for rig utilities, which device comprises:

an outer frame assembly having an opening therethrough, said outer frame assembly supporting a plurality of cables;

an inner beam assembly receivable within said outer frame assembly opening, said inner frame assembly supporting said plurality of cables, wherein said inner beam assembly may be extended from or retracted into said opening of said outer frame assembly;

an elongated post terminating in a rotatable boom base;

a utility boom pivotally connected to said boom base wherein said pivotal connection has an axis transverse to said post, said boom supporting a plurality of cables; and at least one cylinder to move said boom from a storage position substantially perpendicular to said post to a position at an obtuse angle to said storage position in order to carry electrical cables to a drilling floor of a rig.

2. A transportation, storage and installation device for rig utilities as set forth in claim 1 including a bridge track mounted on a motor control center building wherein said outer frame assembly is mounted and supported by said bridge track.

3. A transportation, storage and installation device for rig utilities as set forth in claim 2 wherein said outer frame assembly is movable with respect to said bridge track on a plurality of rollers.

4. A transportation, storage and installation device for rig utilities as set forth in claim 2 including an elongated service arm supporting a plurality of electrical cables, a hinge having an axis transverse to said service arm carrying said electrical cables from said motor control center building, and a pin passing through said axis, said pin held by a bracket secured to a roof of said motor control building to permit said arm to swing radially about said axis.

5. A transportation, storage and installation device for rig utilities as set forth in claim 2 including a first high pressure fluid mud line mounted on a motor control center building and a second high pressure mud line is attached mounted to said outer frame assembly, wherein said first line is in fluid communication with a drill floor and wherein said first and second lines are parallel to each other and may be joined by hammer unions when said outer frame is extended.

6. A transportation, storage and installation device for rig utilities as set forth in claim 2 including a ratcheting jack mechanism to rotate said boom base with respect to said post and thereby move said boom.

7. A transportation, storage and installation device for rig utilities as set forth in claim 2 including a second cylinder which operates to move said boom.

8. A transportation, storage and installation device for rig utilities as set forth in claim 1 wherein said outer frame assembly includes a cable tray to support said plurality of cables and said inner beam assembly includes a plurality of cross supports to support said cables.

9. A transportation, storage and installation device for rig utilities as set forth in claim 1 wherein said post is mounted on a skid frame for a motor control center building.

10. A transportation, storage and installation device for rig utilities as set forth in claim 1 wherein said boom has an end opposite said pivotal connection to said base wherein said opposite end has a pair of extending arms.

* * * * *